United States Patent [19]

Hovland

[11] Patent Number: 4,667,581

[45] Date of Patent: May 26, 1987

[54] WIND RESPONSIVE SOFFIT VENTILATOR

[75] Inventor: Lyle W. Hovland, Murrysville, Pa.

[73] Assignee: Aluminum Company of America, Pittsburgh, Pa.

[21] Appl. No.: 812,017

[22] Filed: Dec. 23, 1985

[51] Int. Cl.[4] ..... F24F 13/10

[52] U.S. Cl. ..... 98/37; 98/119; 98/DIG. 6

[58] Field of Search ..... 98/32, 37, 117, 119, 98/DIG. 6

[56] References Cited

U.S. PATENT DOCUMENTS

| | | | |
|---|---|---|---|
| 501,253 | 7/1893 | Netzer | 98/119 |
| 1,623,286 | 4/1927 | Strahan | 98/119 X |
| 2,212,468 | 8/1940 | Ferris | 98/37 |
| 2,755,728 | 7/1956 | Frisby | 98/37 |
| 4,315,455 | 2/1982 | Shaklee | 98/32 |

FOREIGN PATENT DOCUMENTS

| | | | |
|---|---|---|---|
| 470675 | 5/1926 | Fed. Rep. of Germany | 98/37 |
| 2062842 | 5/1981 | United Kingdom | 98/119 |

*Primary Examiner*—Harold Joyce
*Attorney, Agent, or Firm*—Max L. Williamson

[57] ABSTRACT

A ventilator for attachment to a building soffit which is opened or closed automatically in response to a critical wind velocity. The ventilator includes a damper hingeably attached thereto which is acted upon by a wind of a predetermined velocity to cover the ventilator opening into the building and thereby prevent the introduction of wind-blown snow, rain or other particulate matter into the building.

4 Claims, 6 Drawing Figures

WIND RESPONSIVE SOFFIT VENTILATOR

BACKGROUND OF THE INVENTION

This invention relates to a soffit ventilator. More particularly, it relates to a ventilator which is open to allow passage of air into a building at wind velocities below a predetermined value and closed to prevent air passage at velocities above such value. The predetermined wind velocity is that which is considered to generate an unreasonable risk of accumulating an unacceptable amount of wind-driven snow in the building. Soffit ventilators are well known and are considered to be particularly effective in minimizing heat buildup in spaces under a roof, particularly when used in combination with ridge ventilators. A problem which may arise in the use of a soffit ventilator, however, is the accumulation of wind-driven snow, rain or other particulate matter in the building. A number of factors may affect the amount of snow that might enter and accumulate in a building, such as exposure of the building to the wind, ratio of the soffit ventilator area to the ridge ventilator area, wind velocity, rate of snowfall, temperature and size of flakes, for example. It is apparent, however, that regardless of the various factors, one solution to the problem is to close the ventilator when wind-driven snow conditions are present. At least two patents describe soffit ventilators which may be closed. The ventilator in Frisby U.S. Pat. No. 2,755,728 has a frame which attaches to the soffit. The frame is covered by a screen to allow free passage of air therethrough while keeping insects and small animals out. The frame is also adapted to receive a manually applied snap-on cover when excessive winds occur. Shaklee U.S. Pat. No. 4,315,455 also shows a screened frame which attaches to the soffit and is adapted for closure. It is provided with a panel hinged to one side of the frame which can be moved from an open position to a closed position where it completely covers the screened opening. The panel and frame are adapted so that the panel can be maintained in an open or closed position or a number of intermediate positions therebetween. The Frisby and Shaklee patents describe ventilators which could be effective in preventing snow from accumulating in a building by closing the ventilators, but both of the described ventilators require manual handling of a cover to effect a closure. Devices having slotted or louvered openings which may be opened or closed automatically by moving air are known. Attic exhaust fans, for example, are typically mounted over a louvered opening in a ceiling separating an attic space from a space below. When the fan is turned on, a pressure differential is created between the attic side and lower side of the louvers causing them to open and remain open until the fan is turned off.

SUMMARY OF THE INVENTION

The present invention is directed to a soffit ventilator having an opening therethrough which becomes closed in response to a wind of a predetermined critical velocity to prevent the entry of wind-driven precipitation into the building. The ventilator has a housing which attaches to a building soffit or fascia and wall and has an opening through it to permit the passage of air into the building. A damper, hingeably attached to the housing, is adapted to be maintained in a position which allows for free passage of air through the ventilator when wind is blowing below the predetermined critical velocity.

When the wind is above the critical velocity, the force of the wind acting on the damper causes it to hinge against the opening and remain there so long as the wind is blowing above the critical velocity.

It is an objective of this invention to prevent the entry of precipitation into a building through a soffit ventilator.

It is also an objective of this invention to provide a soffit ventilator which opens or closes in response to a critical wind velocity.

These and other objectives and advantages of the invention will be more apparent with reference to the following description of a preferred embodiment and the accompanying drawings.

DESCRIPTION OF A PREFERRED EMBODIMENT

Figure 1:
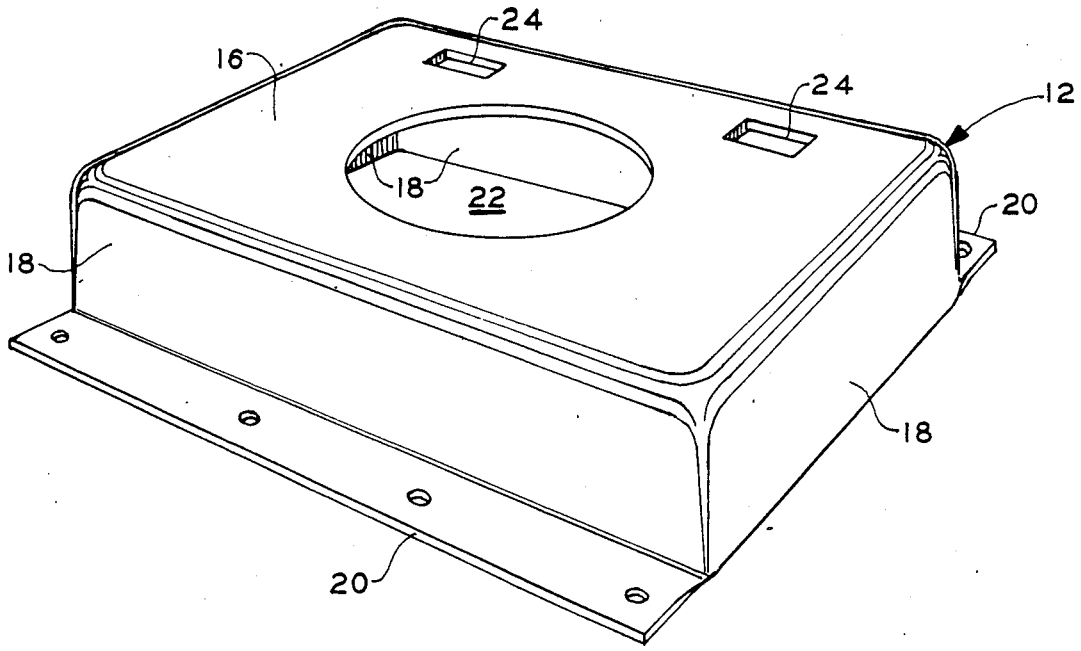
FIG. 1 is a perspective view of a housing of a ventilator of this invention.
Figure 3:
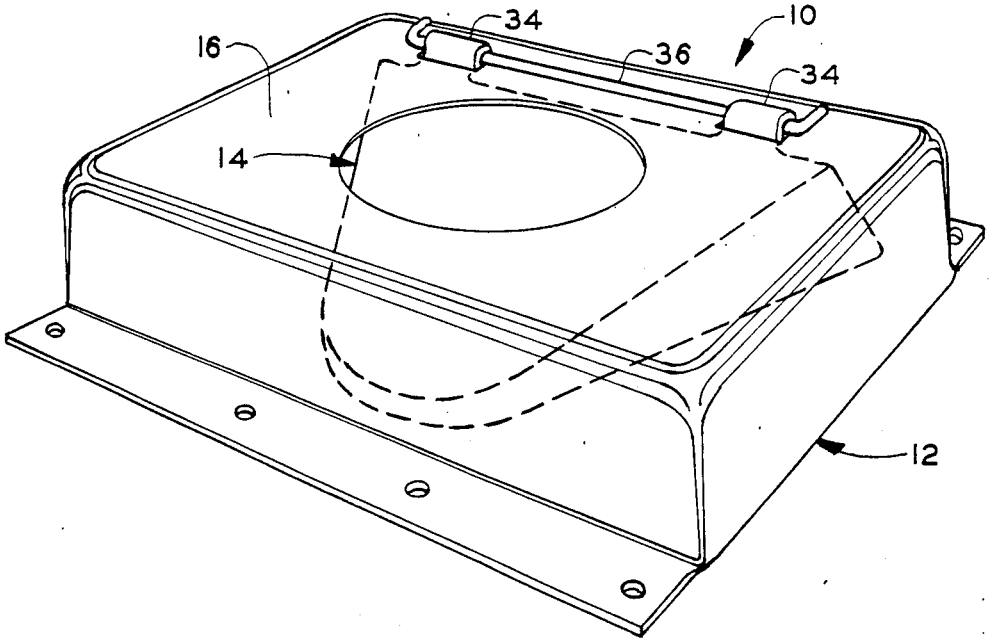
FIG. 3 is a perspective view of the damper shown in FIG. 2 within and in hingeable engagement with the housing shown in FIG. 1.

A ventilator 10 of this invention is comprised of a housing 12 having a damper 14 hingeably attached thereto, as shown in FIG. 3. Referring now to FIG. 1, the housing 12 has a rectangular box shape and may be made from a variety of materials such as plastic, fiberglass or sheet metal, for example. Note that the invention is not limited to a particular shape. A ventilator having a housing of another shape may be within the scope of this invention. If plastic, it may be vacuum formed from a polyvinyl chloride sheet, for example. If metal, it could be formed by stamping, drawing or on a press brake. The choice of material and method of making the housing is a matter of choice. The housing 12 has a top wall 16, four sidewalls 18 depending therefrom, and two nailing flanges 20 projecting outwardly from the free edges of at least two of the sidewalls. A circular opening 22 is centrally located in the top wall 16, and a pair of slots 24 are adjacent to and parallel to a top wall edge and equidistant from a centerline through the housing. The nailing flanges 20 are provided to attach the housing to the soffit, the central opening 22 for passage of air through the ventilator, and the slots 24 for effecting a hingeable connection, as shown in FIG. 3, between the housing and the damper 14.

Figure 2:
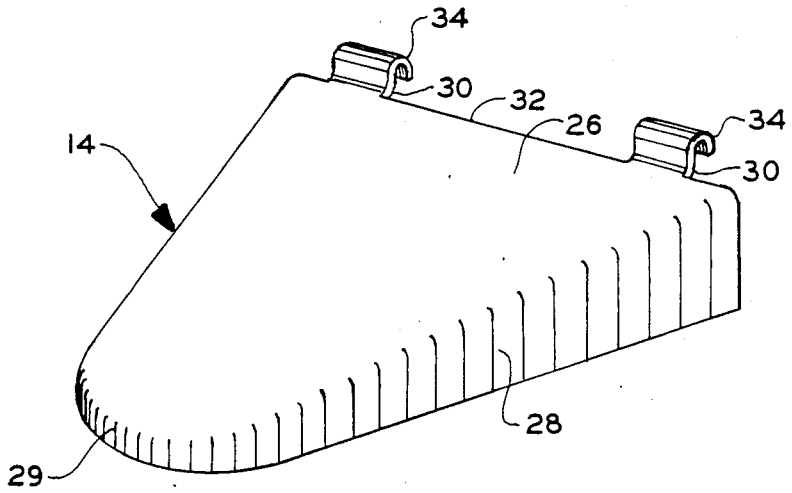
FIG. 2 is a perspective view of a damper of a ventilator of this invention.

Referring next to FIG. 2, the damper 14 is tongue-shaped having a top wall 26 and a skirt or sidewall 28 depending therefrom around the periphery of the top wall except on the rear of the tongue. Like the housing 12, the damper 14 may be made from plastic or metal as a matter of choice. A pair of tabs 30 project upwardly from the back edge 32 of the top wall 26. The tabs 30 are equidistant from a centerline through the damper top wall 26 the same distance as the slots 24 are from the centerline of the housing so that the tabs may be inserted through the slots. The ends of the tabs are formed into hooks 34 to fit over a rod in connecting the damper with the housing, as will be explained later. The skirt 28 is provided to make the damper 14 more rigid and progressively increases in length from the curved nose front end 29 to the back end. The longer length of the skirt on the rear of the damper 14 is for the purpose of controlling the extent of the opening when the damper is in its open position, as will be explained later. Assembly of the damper 14 with the housing 12 is accomplished by placing the damper within the housing and inserting the tabs 30 upwardly through the slots 24 a distance sufficient to raise the hooks 34 above the housing top wall 16. A rod 36 having bent ends is then positioned between the housing top wall 16 and the tab hooks 34, and when the damper 14 is released, it is hung or suspended from the rod 36, as may be seen in FIGS. 3, 4 and 5.

Figure 4:
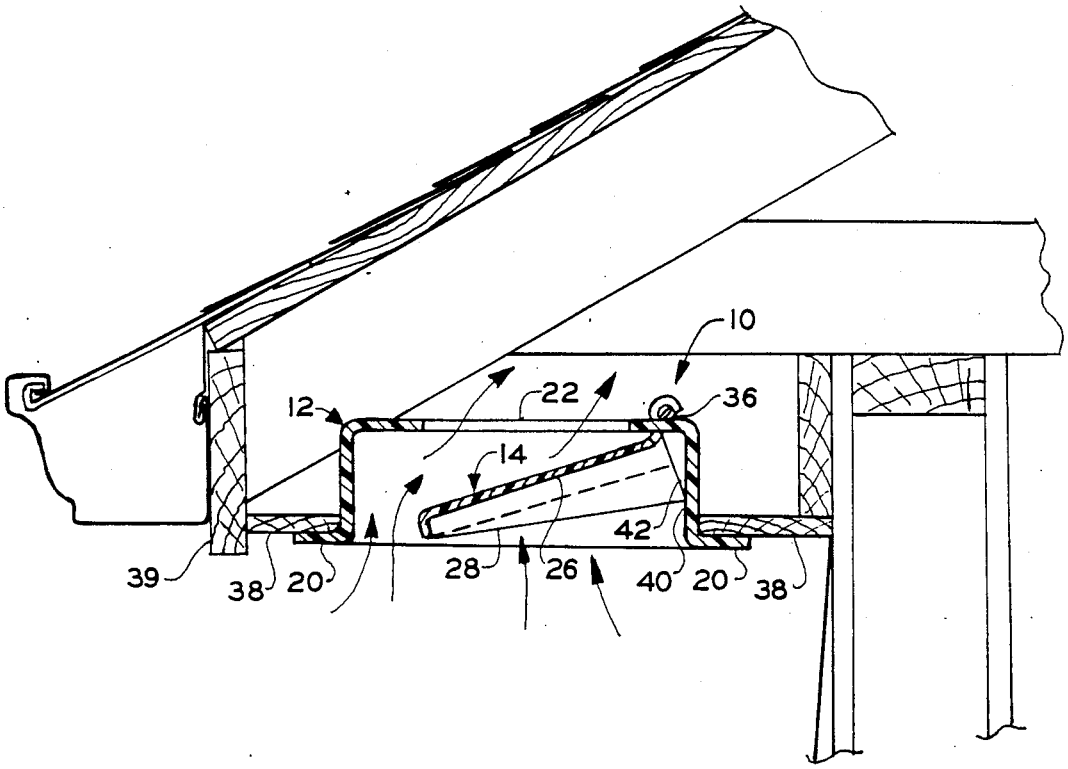
FIG. 4 is a cross-sectional view of the soffit portion of a building and shows a ventilator of this invention installed therein with the damper in an open position.
Figure 5:
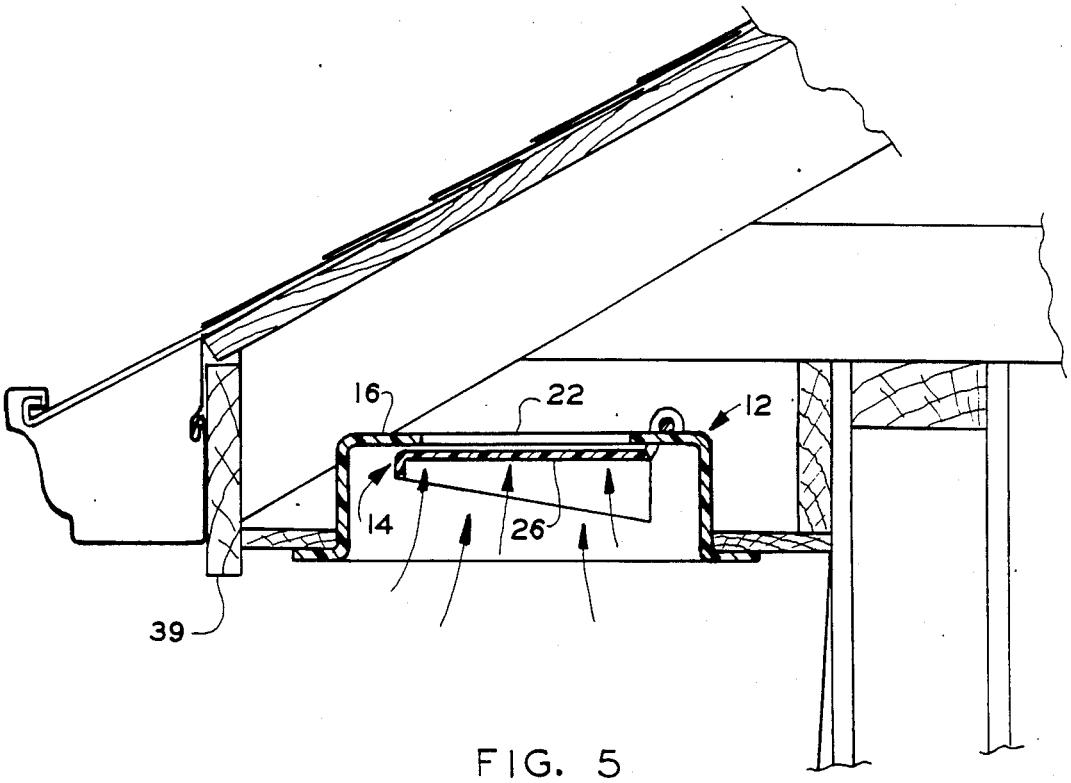
FIG. 5 is the cross-sectional view of FIG. 4 with the damper in a closed position.

Operation of the ventilator 10 will now be explained with reference to FIGS. 4 and 5. In FIG. 4, the ventilator 10 is shown with the damper 14 in its open position. The housing 12 is attached to the soffit 38 with nails or screws through the nailing flanges 20 and the damper 14 is suspended from the rod 36. Although shown in FIGS. 4 and 5 as attached directly to the soffit, it is apparent that the housing 12 could be made larger so that the flanges were fastened directly to the bottom of the fascia board 39 and the building sidewall. In this open position, it may be seen that the damper 14 is spaced away from the opening 22 in the housing 12, and air, indicated by the arrows, can flow up into the housing and around the damper through the opening. In FIG. 5, the damper 14 is in its closed position with its top wall 26 pressed against the housing top wall 16 and covering the opening 22 to block the flow of air therethrough. Whether the damper 14 is in an open position as shown in FIG. 4, or closed as shown in FIG. 5, depends upon a wind-induced force acting upon the damper. The force induced by the wind depends upon the wind velocity and direction. If no damper were provided, it is apparent that the greater the vertical component of the wind, the greater would be the likelihood of accumulating wind-driven snow, rain or other particulate matter through the ventilator. After the vertical component has been determined which is considered to be critical, that is, the air flow which generates too great a risk of accumulating snow blown through the ventilator under typical or average snow conditions, the weight required for a damper 14 having a given surface area can be determined to maintain the damper in a closed position. If the damper 14 is to be closed and remain closed, its weight must be less than that which would create a downward force sufficient to overcome the upward force from the wind blowing against the damper. The shape and size for a given housing size is largely a matter of choice, but it is generally desirable that the damper surface area be kept to a minimum to offer the least resistance to passage of air through the ventilator 10 when the damper 14 is in an open position. The tongue-shaped damper 14 of this preferred embodiment, for example, offers minimal resistance to air flow when it is in an open position. As noted heretofore, this preferred embodiment includes a skirt 28 which increases in length from the front end to the rear in order to maintain the damper 14 at a particular spaced away distance from the opening when in an open position. Referring again to FIG. 4, it may be seen that the bottom corner 40 of the skirt 28 rests against the housing sidewall when the damper 14 is in an open position. It can also be seen that if the skirt 28 were shortened on the rear end, as indicated by the dashed line, for example, the damper 14 would rotate further downward before the skirt corner contacted the housing sidewall, and thus the damper would be spaced away from the opening 22 in the housing 12 a greater distance. The position of the skirt corner 40 can also be effected by altering the angle between the rear edge 42 and the top wall 26. In this preferred embodiment, the angle between the rear edge 42 and the top wall 26 is 90°. If the angle were increased, the position of the corner 40 would move rearward and the damper 14 would be spaced away from the housing opening a lesser distance in an open position. If the angle were decreased, the distance the damper 14 would be spaced away from the opening in an open position would be increased. Having the flexibility of altering the skirt length or changing the angle between the back edge of the skirt 28 and the top wall can be of benefit if weight needs to be added or removed from the damper in order to obtain the desired response at a critical wind force.

Figure 6:
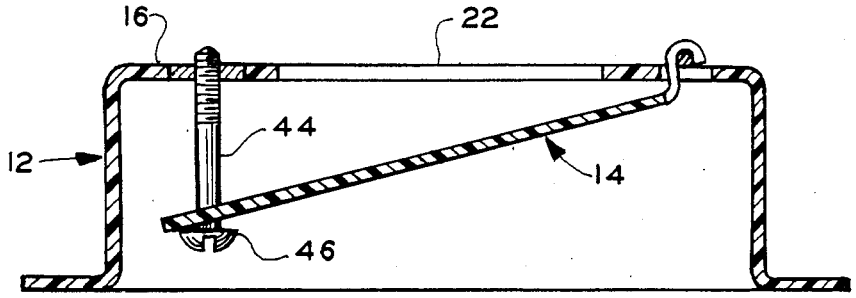
FIG. 6 is a cross-sectional view of an alternate embodiment of a ventilator of this invention.

If it is desired to make the damper 14 as a flat plate with no skirt, the open position of the damper can be controlled as shown in FIG. 6. A spacer rod 44 having a headed end 46 passes through a slotted opening in the nose end of the damper and attaches to the top wall 16 of the housing. If the housing is plastic, as shown, and the spacer rod is metal, the attachment may be made by providing a threaded metal grommet or bushing in the housing top wall 16 and screwing a threaded end of the spacer rod therein. In this alternate embodiment, the weight of the damper is sufficient to swing the damper downward in opposition to any force equal to or less than the critical design force. The downward drop of the damper is controlled by the headed end 46 of the spacer rod.

As has been noted earlier, the housing 12 or damper 14 may be made of metal. If either is made of metal, contact between the two may generate objectionable noise as from a gusting wind, for example. If such is the case, a sound deadening material, such as a foam tape, can be applied to one or the other of the contacting surfaces. The passage of insects and small animals through the ventilator 10 can be controlled by covering the opening defined by the nailing flanges with screen cloth, expanded metal, perforated metal or the like. As an alternative, the opening 22 can be covered by a suitable screening material.

While the invention has been described in terms of preferred embodiments, the claims appended hereto are intended to encompass all embodiments which fall within the spirit of the invention.

What is claimed is:

1. A ventilator for controlling the passage of air through a building soffit, comprising:

a housing having a top wall with a central opening therethrough and sidewalls depending therefrom and having an open bottom;

means for attaching the housing in an opening in a soffit in a building; and a damper within and hingeably attached to the housing and having a portion of sufficient surface area to cover the housing opening and of sufficient weight to hinge downwardly away from the opening in the absence of a wind and capable of being hinged upwardly to cover the housing opening in response to at least a component of the external wind of a predetermined velocity blowing against the damper.

2. A ventilator as claimed in claim 1 which further includes means for limiting the movement of the damper to open the housing opening.

3. A ventilator as claimed in claim 2 wherein the damper includes a top wall for covering the housing opening and a skirt depending therefrom with a portion of the skirt adapted to contact a portion of the housing when the damper is in the open position to limit the movement of the damper and maintain it in such open position.

4. A ventilator as claimed in claim 2 wherein the means for limiting movement of the damper is a rod having a headed end with the rod projecting through an opening in the damper smaller than the headed end and having the end opposite the headed end attached to the housing so that when the damper is in the open position it is in contact with the headed end of the rod.

* * * * *